US007565825B2

(12) United States Patent
Wheatland et al.

(10) Patent No.: US 7,565,825 B2
(45) Date of Patent: Jul. 28, 2009

(54) RESET CRADLE FOR A QUICK REKEY CYLINDER

(75) Inventors: Graham J. Wheatland, Rancho Santa Margarita, CA (US); Jeannette V. Bui, Irvine, CA (US)

(73) Assignee: Newfrey, LLC, Newark, DE (US)

( * ) Notice: Subject to any disclaimer, the term of this patent is extended or adjusted under 35 U.S.C. 154(b) by 0 days.

(21) Appl. No.: 11/904,572

(22) Filed: Sep. 27, 2007

(65) Prior Publication Data

US 2008/0078224 A1 Apr. 3, 2008

Related U.S. Application Data

(60) Provisional application No. 60/848,592, filed on Sep. 29, 2006.

(51) Int. Cl.
*E05B 29/04* (2006.01)

(52) U.S. Cl. ..... 70/383; 70/384; 70/431; 70/492; 70/493; 70/495

(58) Field of Classification Search ..... 70/337–343, 70/368, 382–385, 492–496, 358, 372, 391, 70/431, 461, DIG. 44; 29/434; 33/539, 540
See application file for complete search history.

(56) References Cited

U.S. PATENT DOCUMENTS

| | | | | | |
|---|---|---|---|---|---|
| 1,565,556 | A | | 12/1925 | Fremon | |
| 2,603,081 | A | * | 7/1952 | Pelle | 70/382 |
| 4,372,139 | A | * | 2/1983 | Laake | 70/383 |
| 4,912,953 | A | * | 4/1990 | Wobig | 70/383 |
| 5,103,661 | A | | 4/1992 | Fann et al. | |
| 5,233,850 | A | * | 8/1993 | Schroeder | 70/337 |
| 5,325,690 | A | * | 7/1994 | Adler et al. | 70/383 |
| 5,735,153 | A | * | 4/1998 | Hanneman et al. | 70/493 |
| 5,752,400 | A | * | 5/1998 | Kim | 70/368 |
| 5,839,309 | A | * | 11/1998 | Fantl et al. | 70/493 |
| 5,921,122 | A | * | 7/1999 | Lin | 70/368 |
| 6,142,717 | A | * | 11/2000 | Staiger | 408/115 R |
| 6,263,713 | B1 | * | 7/2001 | Fantl | 70/492 |
| 6,776,017 | B2 | * | 8/2004 | Herdman | 70/338 |
| 6,862,909 | B2 | | 3/2005 | Armstrong et al. | |
| 6,871,520 | B2 | | 3/2005 | Armstrong et al. | |
| 7,162,901 | B2 | * | 1/2007 | Williams | 70/493 |
| 2007/0089468 | A1 | | 4/2007 | Chong et al. | |
| 2008/0011033 | A1 | * | 1/2008 | Chong et al. | 70/383 |

* cited by examiner

*Primary Examiner*—Lloyd A Gall
(74) *Attorney, Agent, or Firm*—Ober / Kaler; Royal W. Craig

(57) ABSTRACT

A reset cradle with integral reset tool assembly, that automatically positions the lock cylinder, the reset tool assembly, and all associated components, and choreographs the operations that need to be performed in the right sequential order. The reset cradle generally comprises a two-section housing including a base section with centrally-protruding tubular post into which the lock cylinder may be inserted, and a separate hub section rotatably seated on the base. Inside the housing, a cam is engaged against the post and is rotatable thereabout along with relative rotation of the two-section housing. A reset member is also operative inside the housing, and is engaged by rotation of the cam for axial displacement into the lock cylinder. Similarly, a detent pin is slidably seated in the post and is engaged by the cam for axial displacement into the lock cylinder. Relative rotation of the two-part housing resets the lock cylinder via the reset member and detent pin, and allows the lock cylinder to be placed in a learn mode for rekeying without a valid key.

19 Claims, 8 Drawing Sheets

RESET CRADLE FOR A QUICK REKEY CYLINDER

CROSS-REFERENCE TO RELATED APPLICATION(S)

The present application derives priority from U.S. Provisional Patent Application No. 60/848,592 filed Sep. 29, 2006.

BACKGROUND OF THE INVENTION

1. Field of the Invention

The present invention relates to keyed-cylinder locks assemblies and, more particularly, to reset cradle for recovering a blown cylinder of a lock assembly of a type employing a quick rekey cylinder.

2. Description of the Background

There is a commercial need to provide interchangeable key-access security so that owners/operators of a premises do not need to replace the lock cylinders every time for example, that tenants change or a tenant key is lost or stolen. This situation is especially acute in multiple-unit buildings such as apartments and office buildings.

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

Electronic key systems now exist to allow an owner to selectively program various key codes, but these systems are cost prohibitive for many business and residential applications.

There have, however, been a few prior efforts to develop a mechanical controlled-access lock. For example, pin tumbler locks which may be rekeyed without removing the tumblers, and therefore rekeyed without a locksmith, are shown in U.S. Pat. No. 1,565,556 of Fremon, issued Dec. 15, 1925, and U.S. Pat. No. 2,603,081 to Pelle, issued Jul. 15, 1952.

U.S. Pat. No. 6,862,909 to Armstrong et al. shows rekeyable lock cylinder and rekeying tool. FIG. 1 illustrates this rekeyable lock cylinder, which comprises a lock cylinder 10, a lock cylinder body 12, and a plug assembly 14. The plug assembly 14 includes a plug body 40, a carrier sub-assembly 42 and a plurality of spring-loaded pins 38, 113. The plug body 40 includes a plug face 44, a keyway opening 52, a rekeying tool opening 54 and a pair of channels 56 extending radially outwardly for receiving anti-drilling ball bearings 60. The carrier sub-assembly 42 includes a carrier 90, a plurality of racks 92, a spring catch 96, a spring-loaded locking bar 94, and a return spring 98. The carrier 90 and the plug body 40 combine to form a cylinder that fits inside the lock cylinder body 12.

To rekey the lock cylinder 10, a valid key is inserted into the keyway and is rotated approximately 90 degrees counter-clockwise from the home position. A paperclip or other pointed device is inserted into the rekeying tool opening 54 and is pushed against the carrier 90 to move the carrier 90 parallel to the longitudinal axis of the lock cylinder 10 into a learn mode. The valid key is removed and a second valid key is inserted and rotated clockwise. The carrier 90 is biased toward the plug face 44 by the return spring 98, causing the racks 92 to re-engage the pins 113. At this point, the lock cylinder 10 is keyed to the second valid key and the first valid key no longer operates the lock cylinder 10. The lock cylinder 10 can be rekeyed further as desired.

One problem with the foregoing rekeyable cylinder is that if the second valid key is not fully inserted during the rekeying process, the pins will not be set to conform to the second valid key, resulting in a "blown cylinder." To aid in recovering a lock cylinder from a blown condition, a manual reset procedure was developed to conform to a profile of a new key, without removing the plug assembly from the cylinder body.

First, with the lock cylinder exposed, a rekeying tool 310 is inserted into the cylinder body 12 to manually position the racks 92 and the pins 113 to release the locking bar 94.

Next, a bracing tool (a simple pin) is used to depress the locking bar 94 and allow the plug body to rotate in the cylinder body to the rekeying position.

Next, the plug 40 is rotated with respect to the cylinder body 12 by 90 degrees. This rotation moves the locking bar 94 into a recess inside the cylinder body 12, which releases the locking bar 94, allowing learn tool 200 to be inserted.

Finally, the learn tool 200 is inserted into the keyslot and this configures the lock cylinder to the learn mode. Once in the learn mode, the rekeying tool 310 and bracing tool are removed and a valid key is inserted in the keyway of the plug assembly. As the new key is inserted, the pins can ride up and down the ramps of the key. Once the key is fully inserted, the pin heights can correlate to the new key. Once the key is rotated to bring the plug 40 to the home position, the racks 92 are then re-engaged with the pins 113, and at this point the lock cylinder 10 is keyed to the new key and any previously valid key no longer operates the lock cylinder 10.

Thus, via the manual reset tool 310, without requiring a valid key, the lock assembly can be placed into a learn mode, in which it can read and conform to a profile of a new key, without removing the plug assembly from the cylinder body.

One difficulty with such manual reset tool 310 is the need for some manual dexterity in handling the lock cylinder, the reset tool assembly, and all associated components of the reset tool that needs to be operated simultaneously (first the rekeying tool 310, then the bracing tool, then cylinder plug 40 rotation, then insertion of the learn tool 200). Another difficulty with such reset tool is the relatively high number of operations that need to be performed in the right sequential order. Such reset tool doesn't have a robust means to prevent someone from performing operations in an incorrect order. Due to these difficulties, proper training needs to be conducted for the user to operate the product.

It would be greatly advantageous to provide a reset cradle with integral components that automatically positions the lock cylinder, inserts a rekeying tool, then a bracing tool, then rotates the cylinder plug 40 to allow insertion of the learn tool 200, all in proper sequence.

SUMMARY OF THE INVENTION

It is an object of the present invention to eliminate the need for manual dexterity when rekeying a rekeyable lock cylinder, making the process more user friendly, fool-proof, and easy to operate with very little or no training.

It is another object to provide a reset cradle for rekeyable lock cylinders as described above that consolidates the various components and operations involved in rekeying the lock, thereby reducing the need for the user to manually perform multiple operations.

It is still another object to provide a reset cradle as described above that prevents users from performing reset operations in an incorrect order.

It is still another object to provide a reset cradle in which most of the working components are hidden inside a housing.

In accordance with the foregoing objects, the present invention is a reset cradle for seating a rekeyable lock cylinder and for resetting the rekeyable lock cylinder with minimal effort. The reset cradle generally comprises a two-section housing including a base section having a centrally-protruding tubular post into which the lock cylinder may be inserted, and a separate hub section rotatably seated on the base. The hub has an aperture for exposing the lock cylinder seated in the post of the base section. Inside the housing, a cam is engaged against the post and is rotatable thereabout along with relative rotation of the two-section housing. A reset member is also operative inside the housing, and this comprises a plurality of protruding prongs. The reset member is slidably seated in the post and is engaged by rotation of the cam for radial displacement of the prongs into the lock cylinder. Similarly, a detent pin is slidably seated in the post and is engaged by the cam for radial displacement into the lock cylinder. Relative rotation of the two-part housing resets the lock cylinder with the reset member and detent pin, and allows the lock cylinder to be placed in a learn mode for rekeying without a valid key.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

As described above, using a manual override or reset tool an operator can reset a lock cylinder by putting it into a learn mode without requiring a valid key. This reset operation could sometimes prove challenging because of the number of actions to perform while holding a compact lock cylinder. The present invention is a reset cradle for manually resetting a quick rekey cylinder without need of a valid key, thereby allowing easier manual reset thereof, and especially for recovery of a blown cylinder of a rekeyable lock assembly.

Figure 2:
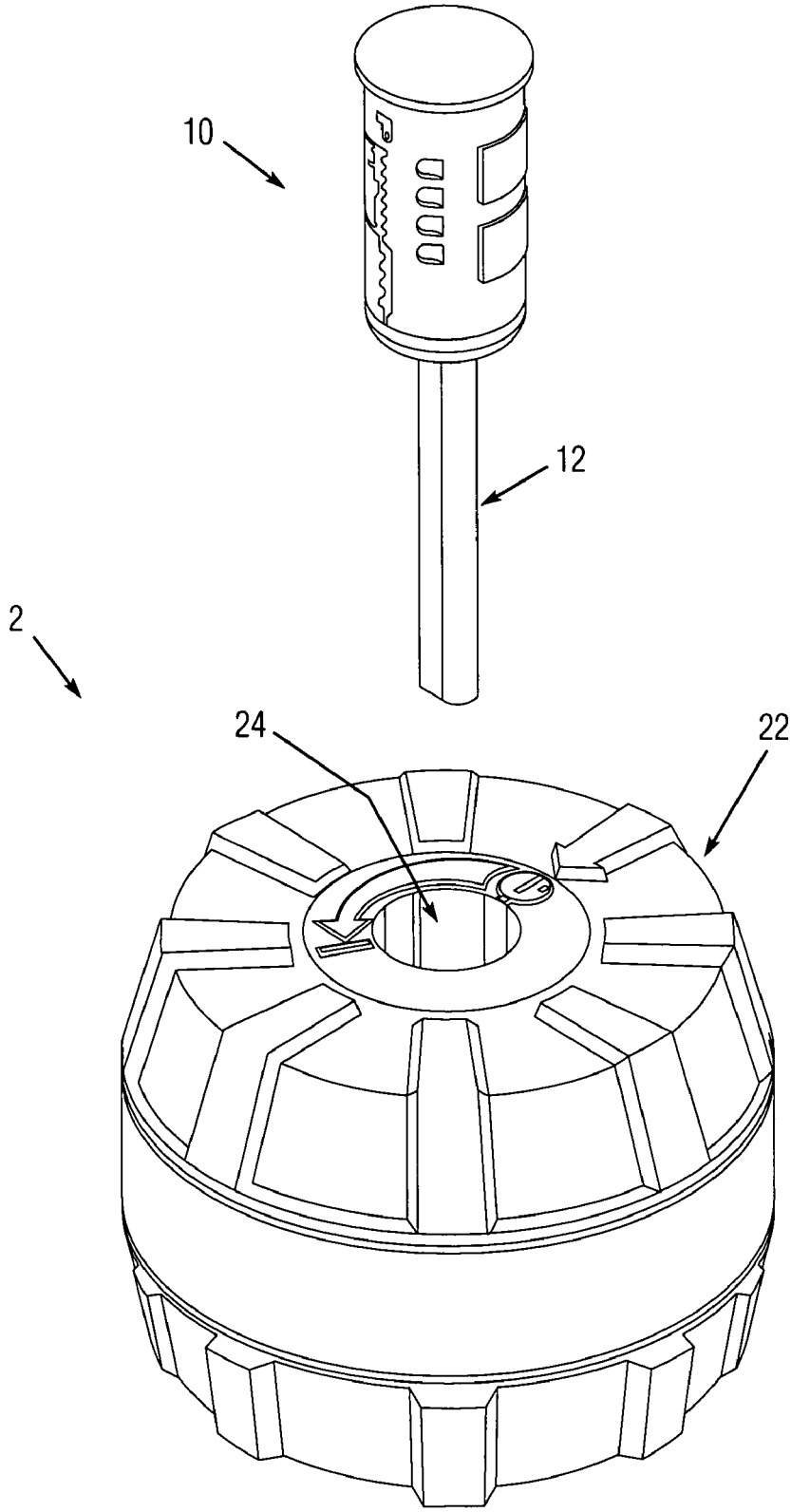
FIG. 2 is a perspective exploded view of the reset cradle 2 according to one embodiment of the present invention.

FIG. 2 is a perspective exploded view of the reset cradle 2 according to one embodiment of the present invention. The reset cradle 2 includes a housing 22 with central recess 24 extending there through configured to receive and seat the lock cylinder 10.

Figure 3:
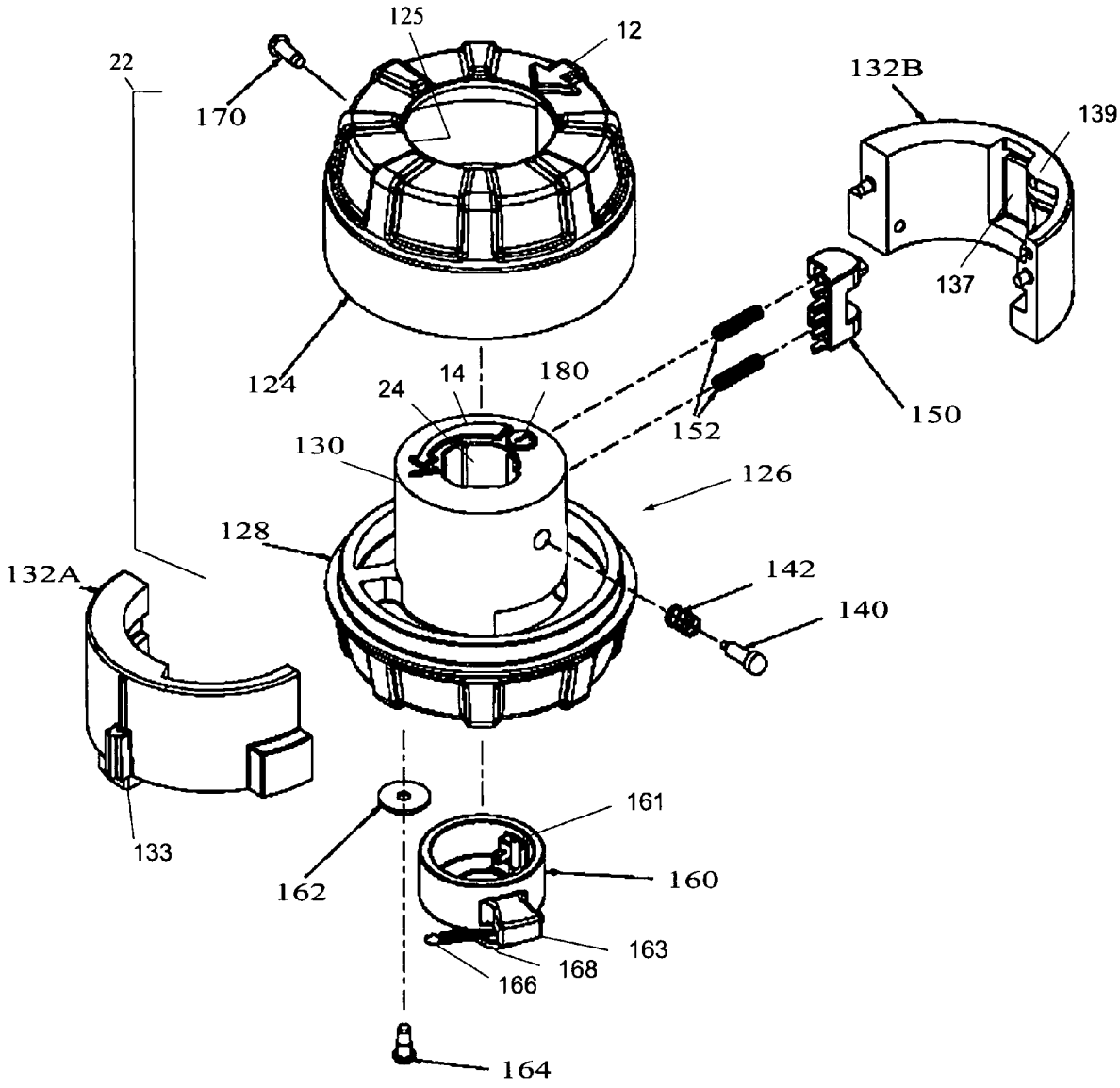
FIG. 3 is an exploded perspective view of the reset cradle 2.

As seen in FIG. 3 the housing 22 further comprises an annular hub 124 rotatably attached to a base 126. Annular hub 124 is a hollow cover that flares outward from a central aperture 125. The annular hub 124 rotatably seats against a peripheral groove 128 formed in the base 126, thereby enclosing an upwardly protruding tubular post 130 formed integrally on the base 126. The post 130 forms a hollow cylinder that defines the central recess 24 for receiving the lock cylinder 10. Post 130 protrudes axially from base 126 so that when hub 124 is seated in groove 128 the cylindrical walls of post 130 conform to the aperture 125 in hub 124. The base 126 is formed with a recess 127 (obscured in FIG. 3, see FIG. 6) in its underside immediately beneath the post 130. A spring-loaded annular driver 160 is rotatably journalled in the recess 127 in base 126. The driver 160 is a hollow annular member having an inwardly-directed radial pin 161 for engaging the lock cylinder when inserted into the reset cradle 2. The driver 160 has a flange 168 at the bottom for anchoring an extension spring 166. The other end of extension spring 166 is connected internally to the base 126 for biasing rotation of the driver 160 with respect to the base 126, providing a spring-return to a home position. The driver 160 also has an outwardly protruding arm 163 that engages a cam as described below. A washer 162 and screw 164 are secured to the bottom of the base 126 to trap driver 160 within the bottom recess. The driver 160 is held captive in the base 126 by a washer 162 screwed into the bottom of the base 126.

Figure 4:
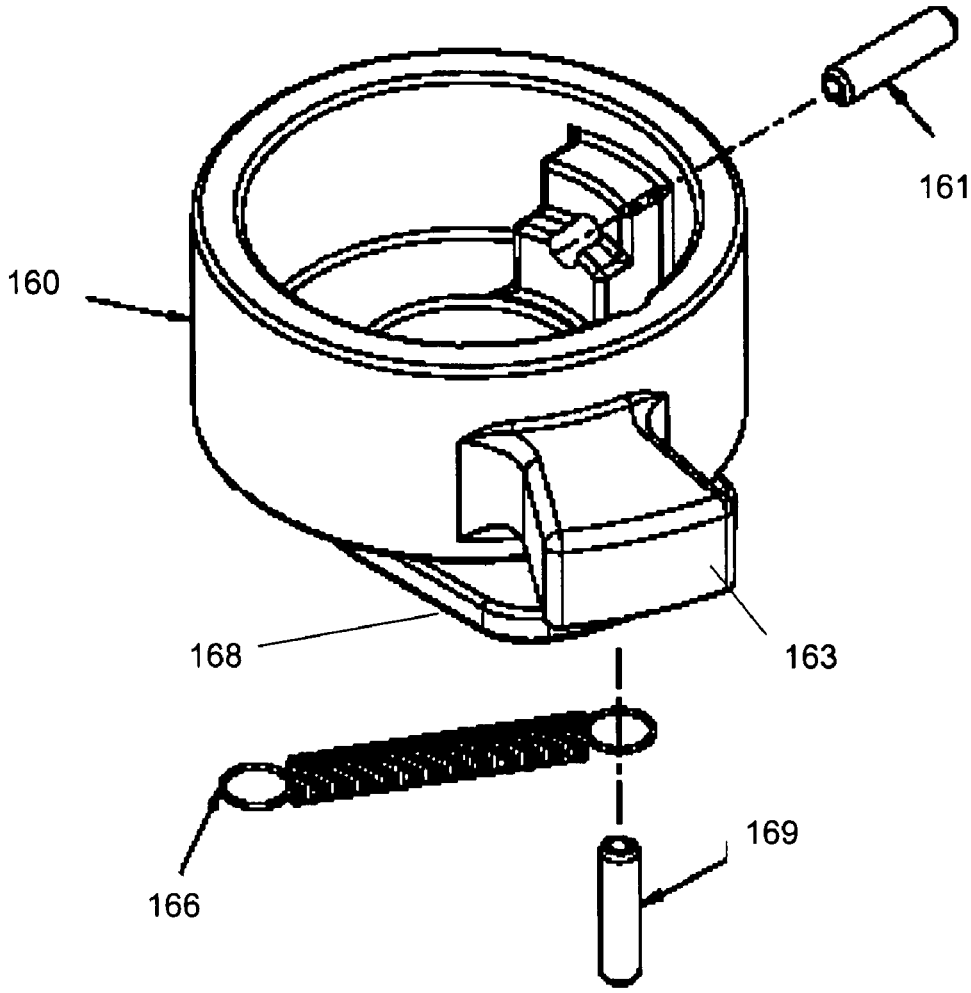
FIG. 4 is an isolated view of the driver 160 with flange 168 there beneath.

FIG. 4 is an isolated view of the driver 160 with flange 168 there beneath. A compression pin 169 is inserted into a bore hole in the flange 168 for anchoring the extension spring 166 for spring-return to a home position. FIG. 4 also provides perspective of the outwardly protruding arm 163 that engages the cam described below. The inwardly-directed axial pin 161 is inserted into a bore-hole in the wall of driver 160 for engaging the lock cylinder once inserted into the reset cradle 2. The axial pin 161 fits into a notch formed in the lowermost edge of the lock cylinder for turning the cylinder. The bore-hole may be formed as a slot to give the axial pin 161 a limited degree of freedom in order to accommodate lock cylinders of different lengths.

Figure 1:
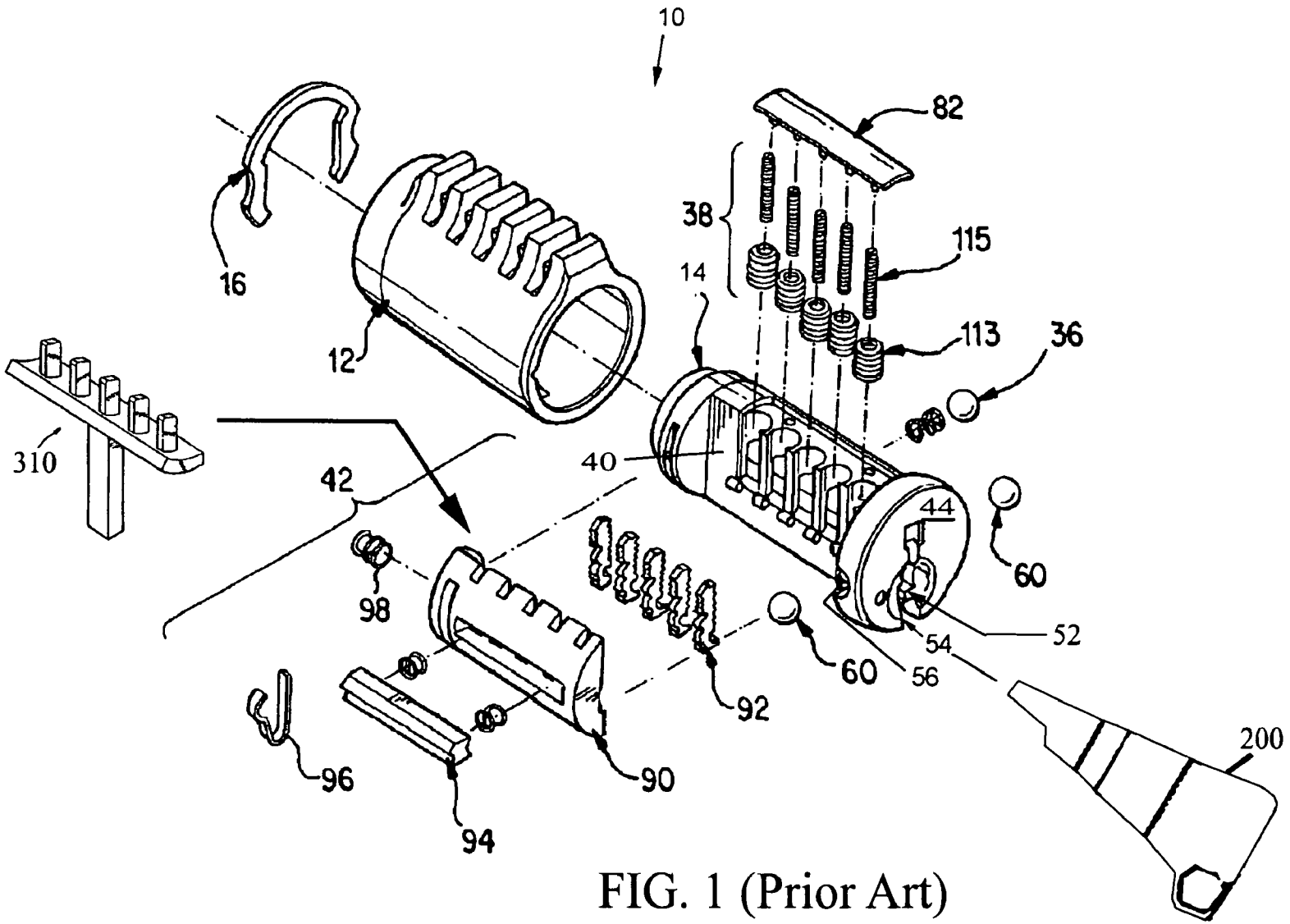
FIG. 1 (Prior Art)
FIG. 1 illustrates a rekeyable lock cylinder and rekeying tool from U.S. Pat. No. 6,862,909 to Armstrong et al.

Referring back to FIG. 3, a two-section cam 132 formed of halves 132A and 132B is rotatably seated on the post 130 inside base 126. The cam 132 can move rotationally along with hub 124 with respect to the base 126. The inner surface of cam 132 comprises a camming surface that radially displaces two operative components mounted in the post 130 of base 126. As the cam 132 rotates around the post 130 of base 126 to a first position, it radially displaces, within a particular order and timing, the two working components both being housed inside the base 126 as will be described. These working components engage the lock cylinder, and are generally spring biased outward so they will return to their starting position once their particular functions are completed. The cam 132 is also formed with a downwardy-protruding finger 133 for engagement with the arm 163 of driver 160. Note also that the finger 133 protrudes laterally from the cam 132 to key the cam 132 to the hub 124 for rotation therewith. As the cam 132 rotates past the first position to a second position the finger 133 of cam 132 engages arm 163 of driver 160 and rotates the driver, which in turn rotates, the plug 40 (see FIG. 1) with respect to the cylinder body 12. Rotation of the plug 40 by 90 degrees with respect to the cylinder body 12 moves the locking bar 94 into the recess inside the cylinder body 12, which releases the locking bar 94, allowing a learn tool 200 to be inserted.

Figure 5:
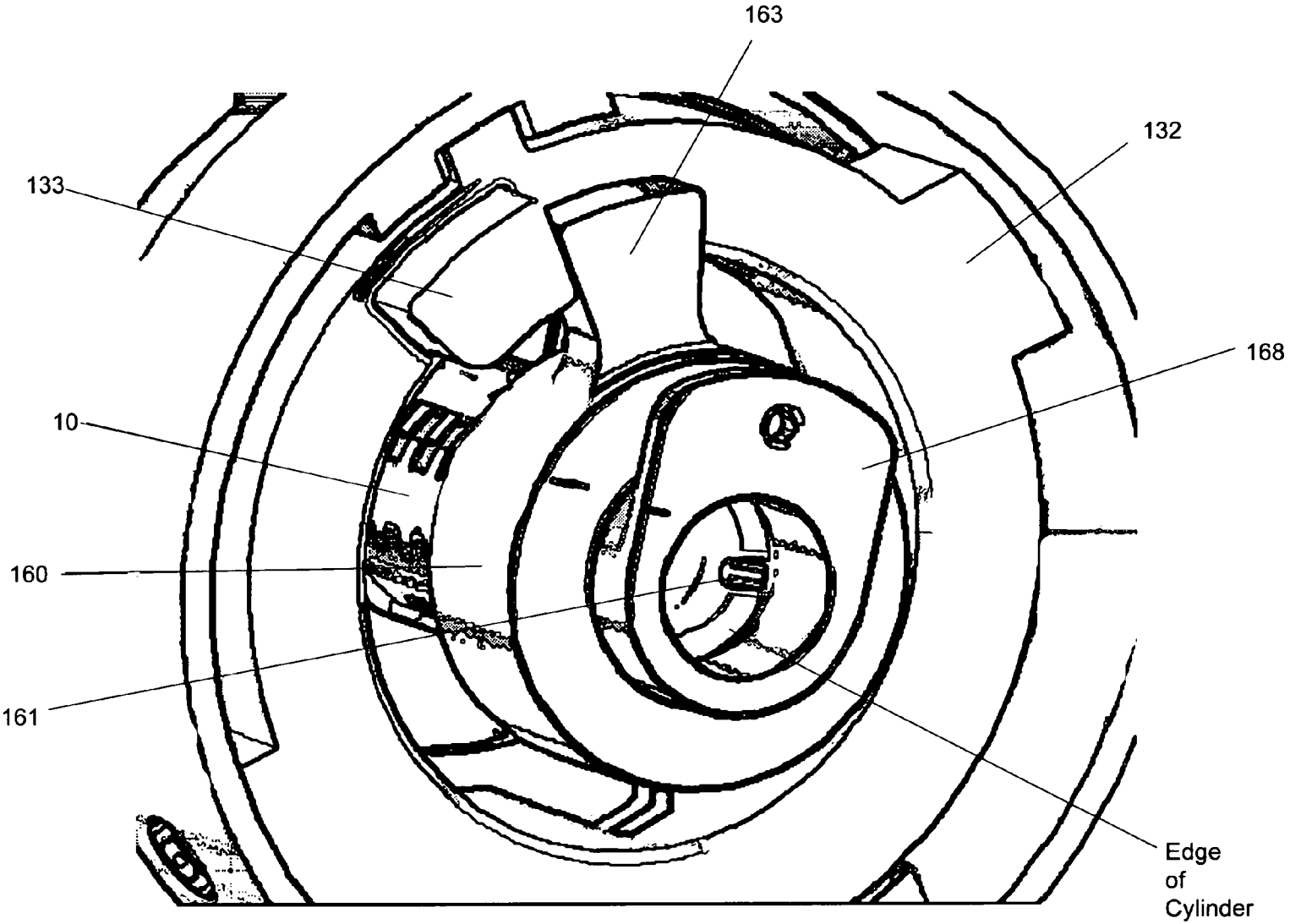
FIG. 5 is an enlarged illustration of the bottom of the reset cradle 2.

FIG. 5 is an enlarged illustration of the bottom of the reset cradle 2 showing the downwardly-protruding finger 133 of cam 132 which, at a predetermined angle of rotation, engages the outwardly protruding arm 163 of driver 160. The driver 160 wields the inwardly-directed axial pin 161 that engages the edge of the lock cylinder (here inserted into the reset cradle 2). Consequently, turning the hub 124 of housing 22 past the first position causes the cam 132 to begin to drive the driver 160, which in turn engages the pin 161 to rotate the lock cylinder seated therein.

The cam 132 is formed with an interior camming surface. As mentioned above, as the cam 132 rotates around the post 130 of base 126, this camming surface radially displaces, within a particular order and timing, two working components both being housed inside the base 126. Referring back to FIG. 3, one of these components is a reset member 150 comprising a shoulder with a plurality of protruding prongs. The reset member 150 generally fulfills the function of the rekeying tool 310 described in the background section with regard to FIG. 1, and the protruding prongs insert into the cylinder body to manually position the cylinder racks and pins to release the locking bar of the lock cylinder. However, in the context of the reset cradle 2 the operation of the reset member 150 becomes automatic. The shoulder of the reset member 150 is rounded and seats within an alcove 137 formed along the inner wall of the cam 132. The forefront of the reset member 150 is slidably seated in a notch formed through the post 130 in base 126, and is spring-biased outward by a pair of springs 152 that engage the post 130. This way, as the hub 124, and hence cam 132 and alcove 137 are rotated the sidewalls of the alcove 137 will engage the reset member 150 and displace it radial into the post 130. Upon radial displacement the prongs of reset member 150 are inserted through the apertures of the cylinder body, such that the prongs of the reset member 150 engage the racks 92 (see FIG. 1) of the rekeyable lock cylinder 10. The reset member 150 thereby relocates the plurality of racks 92, such that the racks are aligned at a common level.

At about the same time that the reset member 150 engages, a detent pin 140 also begins to engage to depress the locking bar 94 and allow the plug body to rotate in the cylinder body to the rekeying position. The detent pin 140 is likewise slidably seated in a through bore formed through the post 130 in base 126, and is spring-biased outward by a spring 142 seated inside the post 130.

Referring back to FIG. 3, the outward end of the detent pin 140 is formed with a rounded cap that engages an arcuate bearing surface 139 protruding inward along the inner wall of the cam 132. This way, as the cam 132 and bearing surface 139 are rotated the bearing surface 139 will engage the detent pin 140 and displace it radially into the post 130 and into the detent ball 36 (FIG. 1) of the lock cylinder 10. Upon radial displacement the pin 140 displaces the locking bar 94, thereby fulfilling the function of the bracing tool (described in the background section) and allowing the plug body 40 to rotate. With the lock cylinder racks 92 aligned by the reset member 150 as above, the detent pin 140 (of FIG. 3) moves the locking bar 94 into engagement with cut-outs in the racks 92, thereby preventing relative movement among the racks, and consequently, relative movement between the pins 113 engaged with the racks 92. This effectively frees the plug body 40 for rotation within the cylinder body 20 and readies the rekeyable lock cylinder 10 for insertion of the learn tool 200.

In the presently-preferred embodiment, the alcove 137 and arcuate bearing surface 139 are formed along the inner wall of the cam 132 in order to move both the reset member 150 and detent pin 140 into the lock cylinder 10 at approximately 33 degrees, and then allow spring-biased retraction of the reset member at approximately 54 degrees while detent pin 140 remains displaced.

Figure 6:
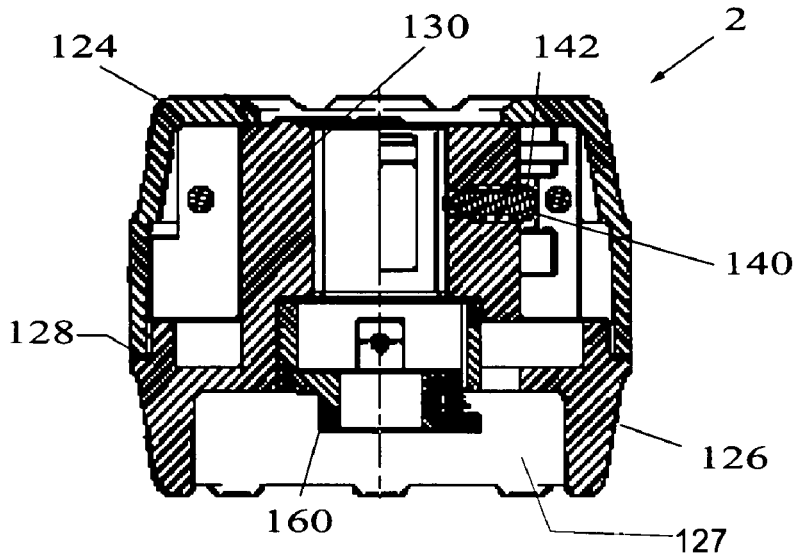
FIG. 6 is a cross-section of the reset cradle 2 of FIGS. 2-3.

FIG. 6 is a cross-section of the of the reset cradle 2 of FIGS. 2-3 with rekeyable lock cylinder 10 removed from the central recess 24 of housing 22. The hub 124 is rotatably seated on the groove 128 of base 126, thereby enclosing post 130 of base 126. The extent of the post 130 is visible as well as its central recess 24 for receiving the lock cylinder 10. Here only cam half 132A is visible. as well as the detent pin 140 which is slidably seated in the through bore formed through the post 130 in base 126. The spring 142 encircles the detent pin 140 and abuts a constriction inside the through-bore in post 130.

Figure 7:
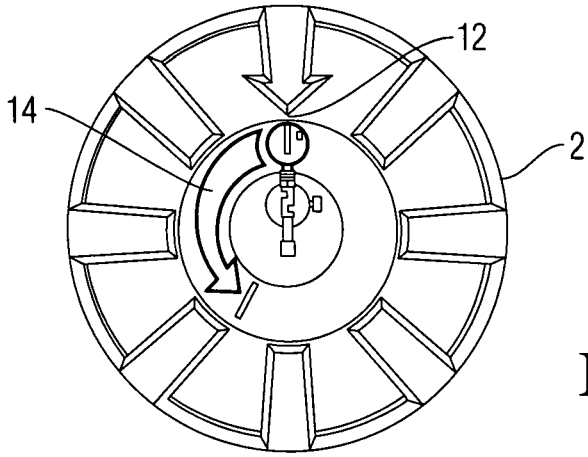
FIGS. 7-9 are composite views of the reset cradle 2 in the home (0 degree) position.

In use, the user should first ensure that the arrow on the front annular hub 124 is in the starting (0 degree) position, as shown in FIG. 7. If not, then the front hub 124 should be returned clockwise until it bottoms out (indicating the starting position shown in FIG. 7). The user then rotates the hub 124 of reset cradle 2 from the home position to a first position (54 degrees) which displaces detent pin 140 and reset member 130 into the lock cylinder as described above, and then retracts the reset member 150, followed by 90 degree rotation to a second 146 degree position which rotates the plug 40 within the cylinder body 20 and readies the rekeyable lock cylinder 10 for insertion of the learn tool 200. The learn tool 200 may then be inserted and the lock cylinder rekeyed.

Figure 8:
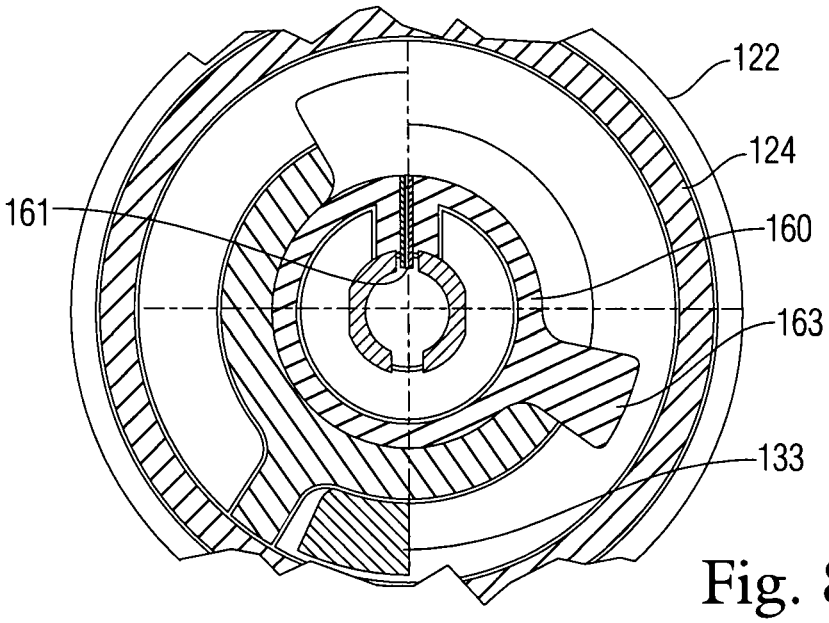
Figure 9:
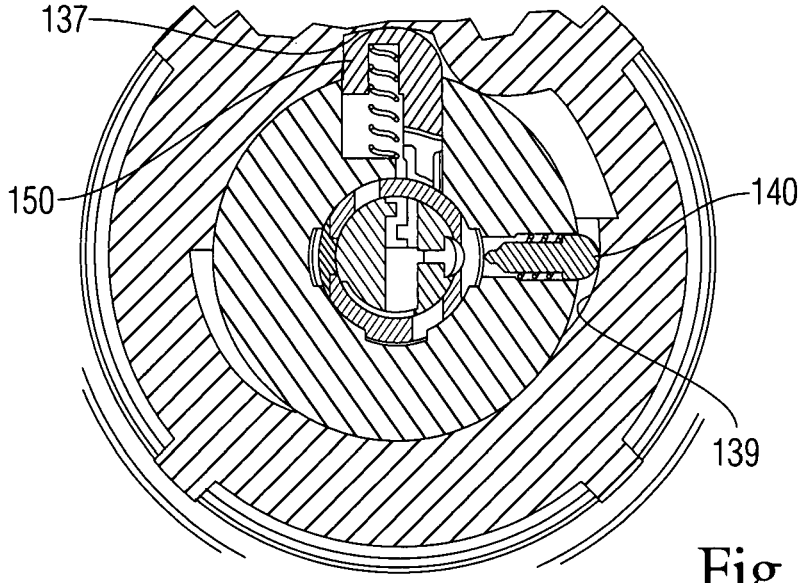

FIGS. 7-15 are sequential illustrations of the operation of the reset cradle 2. Specifically, FIGS. 7-9 are a front view of the reset cradle 2 in the home (0 degree) position, a lower cross-section showing the position of driver 160, and an upper cross-section showing the positions of the reset member 150 and detent pin 140 relative to post 130 and cam 132, respectively. An arrow 12 embossed in the front face of the hub 22 of the reset cradle 2 tells the user that the assembly is in the home (0 degree) position, as shown in FIG. 7. A second arrow 14 tells the user the direction to turn. While in the starting position the rekeyable lock cylinder 10 may be inserted frontally into the reset cradle 2 (already done so as shown).

Thus, as seen in FIG. 8, the arm 163 of driver 160 is not engaged since the hub 124 must be rotated approximately past the first (54 degree) position before the finger 133 protruding downward from cam 132 engages the arm 163 of the driver 160. Likewise, as seen in FIG. 9, the reset member 150 remains seated in the alcove 137 of cam 132 and is spring-biased fully outward so as not to engage the lock cylinder, and the detent pin 140 has not yet engaged the cam surface 139 of cam 132 and is spring-biased fully outward so as not to engage the lock cylinder.

Further rotation to the first (54 degree) position extends both the reset member 150 and the detent pin 140 into the lock cylinder, then retracts the reset member 150.

Figure 10:
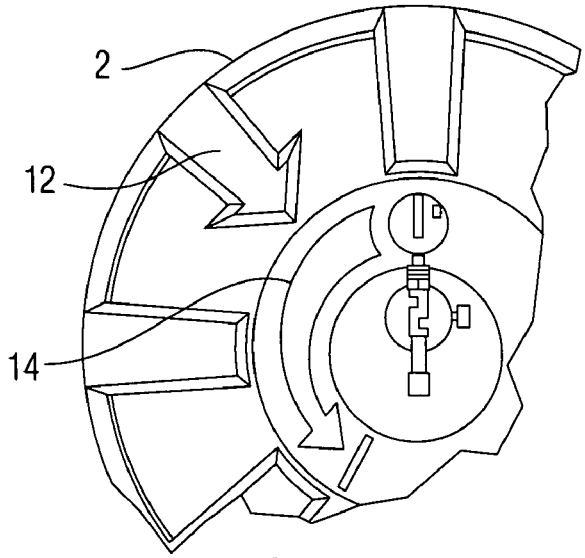
FIGS. 10-12 are composite views of the reset cradle 2 in the first (54 degree) position.
Figure 11:
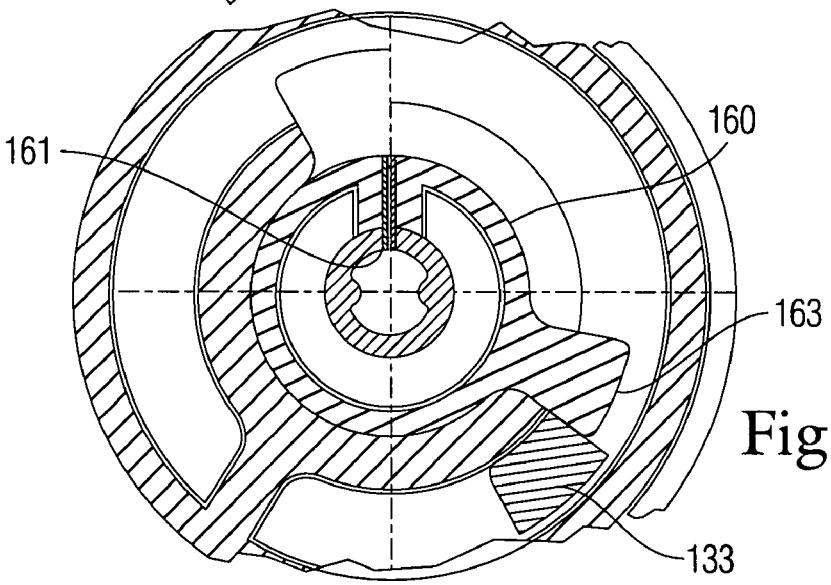
Figure 12:
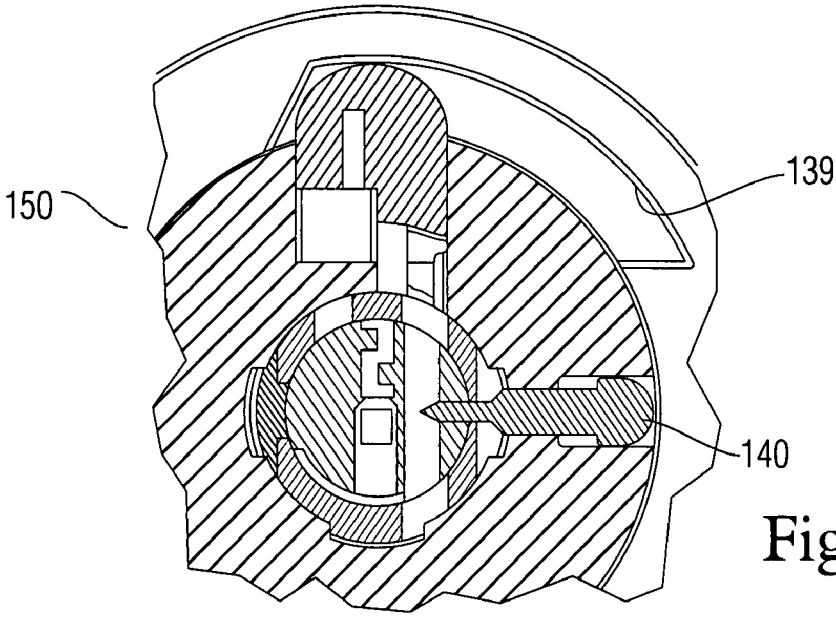

FIGS. 10-12 are a front view of the reset cradle 2 in the first (54 degree) position, a lower cross-section showing the position of driver 160, and an upper cross-section showing the positions of the reset member 150 and detent pin 140 relative to post 130 and cam 132, respectively. The arrow 12 on the reset cradle 2 tells the user that the assembly has been rotated 54 degrees to the first position, as shown in FIG. 10, where the arrow 12 is 54 degrees offset from the keyslot of the lock.

As seen in FIG. 11, this rotation turns the cam 132 and at approximately 54 degrees of rotation engages the arm 163 of driver 160 with the finger 133 of the cam 132. The lock cylinder does not rotate.

Meanwhile, as seen in FIG. 12, at approximately 22 degrees the reset member 150 engages the walls of the alcove 137 of cam 132 and is urged inward to engage the lock cylinder. At approximately 33 degrees the detent pin 140 begins to engage the cam surface 139 of cam 132 and is radially extended through the post 130 to engage the lock cylinder. This in turn moves the locking bar 94 (FIG. 1) into engagement with cut-outs in the racks 92, thereby preventing relative movement among the racks, and consequently, relative movement between the pins 113 engaged with the racks 92. By full rotation the first 54 degree position the cam 132 frees the reset member 150. which retracts, but the detent pin 140 remains engaged. While in this configuration it is now necessary to rotate the plug 40 (FIG. 1) approximately 90 degrees within the cylinder body 12 in order to move the locking bar 94 into the recess inside the cylinder body 12, which in turn releases the locking bar 94, allowing learn tool 200 to be inserted. This rotation is implemented by operation of the driver 60.

Figure 13:
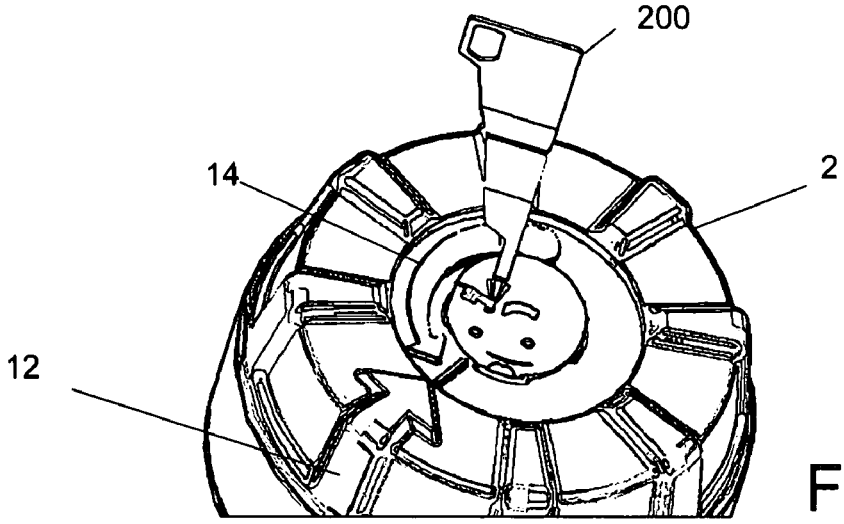
FIGS. 13-15 are composite views of the reset cradle 2 in a second (146 degree) position.
Figure 14:
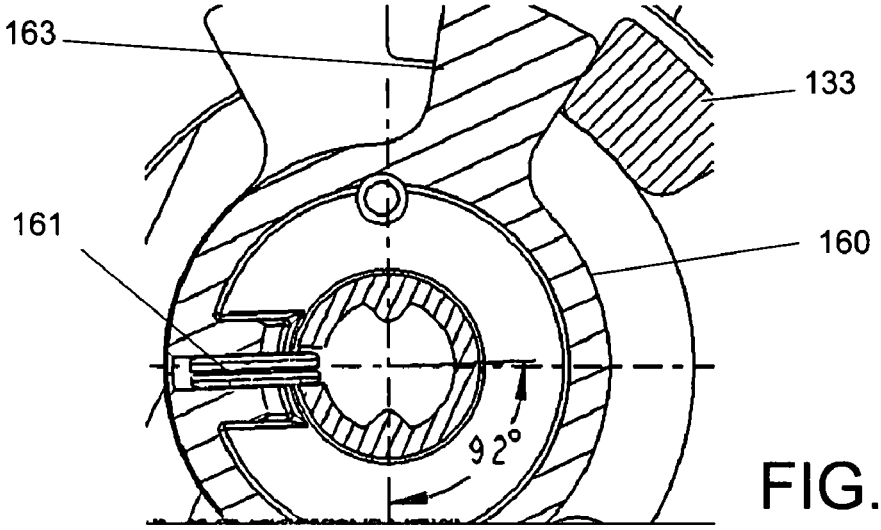
Figure 15:
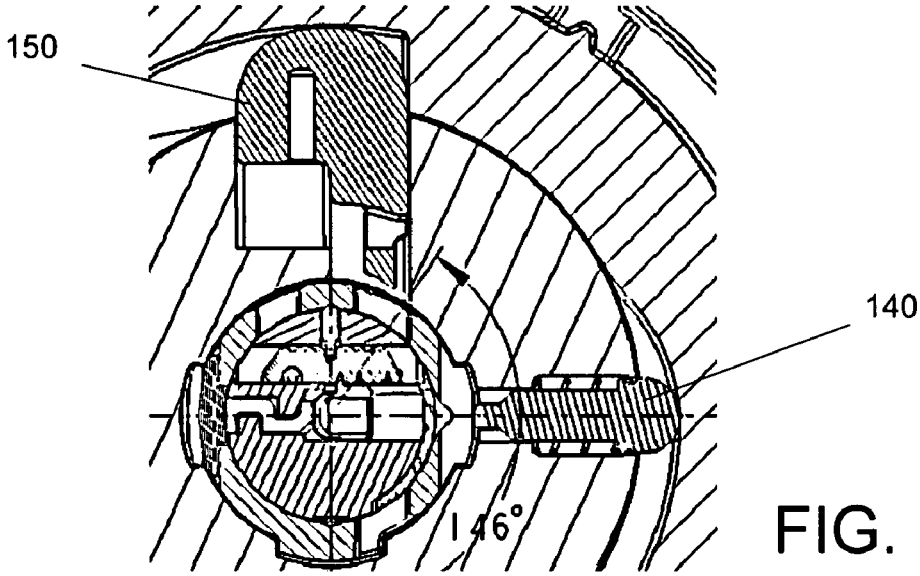

FIGS. 13-15 are a front view of the reset cradle 2 in a second (146 degree) position, a lower cross-section showing the position of driver 160, and an upper cross-section showing the positions of the reset member 150 and detent pin 140 relative to post 130 and cam 132, respectively. The arrow 12 on the reset cradle 2 tells the user that the assembly has been rotated 146 degrees to the third position, which puts the lock cylinder in the learn mode, as shown in FIG. 13, where the arrow 12 is 146 degrees offset from the starting position. As stated above, at 54 degrees of rotation the arm 163 of driver 160 is engaged with the finger 133 of the cam 132. Consequently, this segment of rotation between 54-146 degrees turns the cam 132 as well as the plug along with the hub 124. This can be seen in FIG. 14 where the plug 40 itself is rotated approximately 90 degrees within the lock cylinder body 12.

Meanwhile, as seen in FIG. 15, as the cam rotates to the third position the cam 132 opens up again for the detent pin 140, the detent pin 140 falling back into the recess of the cam surface 139 and retracting from the post 130. This backs the locking bar 94 (FIG. 1) out of engagement with cut-outs in the racks 92, thereby allowing relative movement among the racks, and consequently, relative movement between the pins 113 engaged with the racks 92. This effectively readies the rekeyable lock cylinder for insertion of the learn tool 200.

Referring back to FIG. 13, the learn tool 200 may next be inserted into the keyslot in the face of the lock cylinder to configure the lock cylinder to the learn mode.

Once in the learn mode, the lock cylinder can be removed from the reset cradle 2 and a valid key inserted in the keyway of the lock cylinder. The new key is inserted and rotated clockwise 90° to key the lock cylinder 10 to the new key (the cylinder pins correlating to the new key). Thus, rotating the key back 90 degrees to the home position effectively keys the lock cylinder 10 to the new key. Any previously valid key no longer operates the lock cylinder 10. Thus, via the reset cradle 2, without requiring a valid key, the lock assembly can be rekeyed without removing the plug assembly from the cylinder body.

Once the lock cylinder is removed from the reset cradle, then the reset cradle is returned to its home position, and indeed the return-bias spring 166 promotes this return.

By using the reset cradle 2 the process of rekeying the lock cylinder 10 becomes easier to handle. First the reset cradle 2 holds the lock cylinder 10 in place thereby freeing up one hand of the operator. Also, the reset cradle 2 automatically operates the reset member 150 and the bracing bar, thereby eliminating the need for manual manipulation of these components. This facilitates both the operation of engaging the prongs of the reset member 150 against the racks 92 (FIG. 1) and the action of using the bracing bar to move the locking bar 94 (FIG. 1) into engagement with the racks 92.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A reset cradle for seating a rekeyable lock cylinder and for resetting the rekeyable lock cylinder, comprising:

a housing further comprising a base having a central recess for insertion of a rekeyable lock cylinder, and a hub attached to said base and rotatable about said central recess;

an internal cam disposed inside said hub and rotatable therewith;

a reset member seated inside said housing and being radially extendable by engagement of said cam with said reset member;

a detent pin seated inside said housing and being radially extendable by engagement of said cam with said detent pin.

2. The reset cradle according to claim 1, wherein said hub comprises a hollow cover with a central aperture atop said base.

3. The reset cradle according to claim 1, wherein said base comprises a hollow axial post defining the central recess that protrudes to a central aperture of said hub.

4. The reset cradle according to claim 1, further comprising an annular driver rotatably coupled to said base.

5. The reset cradle according to claim 1 further including a driver for engaging a rekeyable lock plug when the rekeyable lock cylinder is inserted into the reset cradle.

6. The reset cradle according to claim 5, wherein said driver comprises an outwardly protruding arm for engaging said cam.

7. The reset cradle according to claim 1, wherein said cam comprises two sections.

8. The reset cradle according to claim 1, wherein rotation of said cam drives the reset member and detent pin seated inside said housing.

9. The reset cradle according to claim 1, wherein rotation of said hub and cam from a home position to a first position drives the reset member and detent pin into the lock cylinder followed by retraction of the reset member.

10. The reset cradle according to claim 9, wherein rotation of said hub and cam from said first position to a second position drives a driver to rotate a plug body of said lock cylinder.

11. The reset cradle according to claim 1, wherein said reset member comprises a shoulder with a plurality of protruding prongs.

12. The reset cradle according to claim 1, wherein said hub is demarcated with indicia to indicate a rotation position relative to said base.

13. A reset cradle for seating a rekeyable lock cylinder and for resetting the rekeyable lock cylinder, comprising:

a two-section housing including a base section having a centrally-protruding post adapted to seat said lock cylinder, and a hub section rotatably seated on said base section and having an aperture for exposing the post of said base section;

a cam engaged against said post and rotatable thereabout upon relative rotation of said two-section housing;

a reset member slidably seated in said post and engageable by said cam for radial displacement into said lock cylinder;

a detent pin slidably seated in said post and engageable by said cam for radial displacement into said lock cylinder.

14. The reset cradle according to claim 13, further comprising an annular driver rotatably captured in a recess of said base section for engaging a plug when the rekeyable lock cylinder is inserted into the reset cradle.

15. The reset cradle according to claim 13, wherein rotation of said cam from a home position to a first position drives the reset member and detent pin into the lock cylinder followed by retraction of the reset member.

16. The reset cradle according to claim 13, wherein rotation of said hub section and cam from a first position to a second position drives a driver to rotate a plug body of said lock cylinder.

17. A method of rekeying a rekeyable lock cylinder, comprising the steps of:

removing the rekeyable lock cylinder from a lock;

inserting said rekeyable lock cylinder into a central recess of a reset cradle;

rotating a portion of said reset cradle about said central recess to drive a reset member into said rekeyable lock cylinder.

18. The method of claim 17 wherein the step of rotating further includes the step of driving a detent pin into the lock cylinder, the reset member and detent pin being driven in a predetermined sequence.

19. A method of rekeying a rekeyable lock cylinder having a cylinder housing and a plug body disposed in the cylinder housing, the method comprising the steps of:

removing the rekeyable lock cylinder from a lock;

inserting said rekeyable lock cylinder into a central recess of a reset cradle;

rotating a portion of said reset cradle about said central recess to rotate the plug body relative to the cylinder housing, drive a reset member into said rekeyable lock cylinder, and drive a detent pin into the rekeyable lock cylinder in a predetermined sequence.

* * * * *